US006099246A

United States Patent [19]

Lochner et al.

[11] Patent Number: 6,099,246

[45] Date of Patent: Aug. 8, 2000

[54] ADMISSION SECTION OF A TURBINE CASING

[75] Inventors: Klaus Lochner, Markersdorf-Pfaffendorf; Hartmut Schreiber, Spree, both of Germany

[73] Assignee: Siemens Aktiengesellschaft, Munich, Germany

[21] Appl. No.: 09/369,718

[22] Filed: Aug. 6, 1999

Related U.S. Application Data

[63] Continuation of application No. PCT/DE98/00239, Jan. 27, 1998.

[51] Int. Cl.[7] ..... F01B 25/02; F03B 1/04

[52] U.S. Cl. ..... 415/155; 415/214.1

[58] Field of Search ..... 415/151, 155, 415/214.1; 137/884; 285/25, 26, 28, 29, 124.1, 124.2, 124.3, 124.4, 124.5

[56] References Cited

U.S. PATENT DOCUMENTS

| | | | |
|---|---|---|---|
| 373,051 | 12/1887 | Junggren | 415/155 X |
| 893,149 | 7/1908 | Dougherty | 415/155 X |
| 2,147,874 | 2/1939 | Zetterquist | 415/155 X |
| 2,294,127 | 8/1942 | Pentheny | 415/155 |
| 2,308,897 | 1/1943 | Stearns | 415/214.1 X |
| 2,380,606 | 7/1945 | Moody | 415/151 X |
| 2,449,002 | 9/1948 | Moody | 415/155 |
| 2,978,223 | 4/1961 | Keeney et al. | 415/151 |
| 3,350,061 | 10/1967 | Strass | 415/155 X |
| 3,642,381 | 2/1972 | Wickl | 415/151 |
| 3,677,658 | 7/1972 | Dinenno, Jr. et al. | 415/151 X |
| 4,235,416 | 11/1980 | LaCoste et al. | 251/86 |
| 4,456,032 | 6/1984 | Straslicka | 137/630.19 |
| 4,847,039 | 7/1989 | Kendall et al. | 415/155 X |
| 4,850,793 | 7/1989 | Silvestri, Jr. et al. | 415/155 X |
| 4,936,002 | 6/1990 | Silvestri, Jr. et al. | 29/889.2 |
| 5,018,355 | 5/1991 | Foster | 60/646 |
| 5,090,205 | 2/1992 | Foster | 60/646 |

*Primary Examiner*—John E. Ryznic
*Attorney, Agent, or Firm*—Herbert L. Lerner; Laurence A. Greenberg; Werner H. Stemer

[57] ABSTRACT

In order to be able to realize especially high live-steam parameters (i.e. live-steam temperatures and live-steam pressures) in a steam turbine, an admission section of the turbine casing which has a number of throughflow openings and is intended for a valve casing for control valves, has a sealing surface which encloses each of the throughflow openings. For an especially reliable seal, a high surface pressure is achieved in the sealing-surface region owing to the fact that an outer contour of the sealing surface is shaped so as to be constricted in the region between adjacent throughflow openings and that, screws of different dimensions are expediently disposed along the constricted outer contour.

6 Claims, 2 Drawing Sheets

ADMISSION SECTION OF A TURBINE CASING

CROSS-REFERENCE TO RELATED APPLICATION

This is a continuation of International Application No. PCT/DE98/00239, filed Jan. 27, 1998, which designated the United States.

BACKGROUND OF THE INVENTION

Field of the Invention

The invention relates to an admission section of a turbine casing of a steam turbine, in particular an industrial turbine.

In a steam turbine, steam, which serves as a flow medium, is expanded so as to perform work until it condenses. Such a steam turbine or fluid-flow machine having a mechanical output of, for example, 5 to 100 MW is normally used as an industrial turbine. In exactly the same way as a power plant turbine, an industrial turbine is also provided with an admission section, via which live steam fed to the steam turbine flows into the turbine casing. The flow of live steam is adjusted by a number of control valves, which are disposed as individual or group control valves in a valve casing connected to the admission section of the, turbine casing via a flange. Published, Swiss Patent Application CH 665 450 A5, for example, discloses a corresponding flanged joint having an individual throughflow opening. A flanged joint enclosing several throughflow openings is disclosed in International Patent Application WO 85/03986 in which, by use of variable fastening elements, the relative position of the control valve(s) to the turbine casing is adjustable.

At an admission section having a flange-mounted valve casing, in particular in the case of high steam parameters, i.e. at high live-steam pressures and high live-steam temperatures, correspondingly high requirements are imposed on the seal between the admission section of the turbine casing and the control-valve casing.

SUMMARY OF THE INVENTION

It is accordingly an object of the invention to provide an admission section of a turbine casing that overcomes the above-mentioned disadvantages of the prior art devices of this general type, which admission section has an especially suitable seal for a mounted valve casing.

With the foregoing and other objects in view there is provided, in accordance with the invention, an admission section of a turbine casing of a steam turbine, the admission section contains a flanged joint having at least two throughflow openings formed therein and being connectable to a further flanged joint of a valve housing for control valves, the flanged joint having a sealing surface with an outer contour completely enclosing each of the at least two throughflow openings, the flanged joint further has a configuration of screw holes formed therein for receiving screws and is adapted to the outer contour of the sealing surface.

In this case, the seal between the admission section of the turbine casing and the control-valve casing is made within the flanged joint by surrounding each individual throughflow opening assigned to a control valve with a sealing surface.

The corresponding sealing surfaces in the admission section and in the control-valve casing are in each case combined to form a sealing surface common to all throughflow openings and at the same time expediently have an outer contour which is constricted in the region between adjacent throughflow openings. In this case, in order to achieve an especially high surface pressure in the region of the sealing surfaces, the flanged joint advantageously has a configuration of screw holes which is adapted to the outer contour of the sealing surface. In addition, the screw holes have at least two high surface pressure in the region of the sealing surfaces, different diameters for screws of correspondingly different dimensions being provided along an outer contour of the sealing surface of each throughflow opening.

In an expedient development, a tongue-and-groove engagement is provided inside the flanged joint in the region of the sealing surfaces, in which case each of, for example, four throughflow openings has a shoulder contour for the seating of a corresponding collar contour of the valve casing.

The advantages achieved by the invention consist in particular in the fact that an especially reliable seal is obtained between the turbine casing and the control-valve casing by a sealing surface being configured in such a way that the latter completely encloses each throughflow opening assigned to a control valve. Especially high live-steam parameters can thereby be realized in a steam turbine having a corresponding turbine casing. In this case, an especially high surface pressure is achieved in the sealing-surface region owing to the fact that, on the one hand, the outer contour of the sealing surface is shaped so as to be constricted in the region between adjacent throughflow openings and that, on the other hand, screws of different dimensions are expediently disposed equidistantly along this constricted outer contour.

Other features which are considered as characteristic for the invention are set forth in the appended claims.

Although the invention is illustrated and described herein as embodied in an admission section of a turbine casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
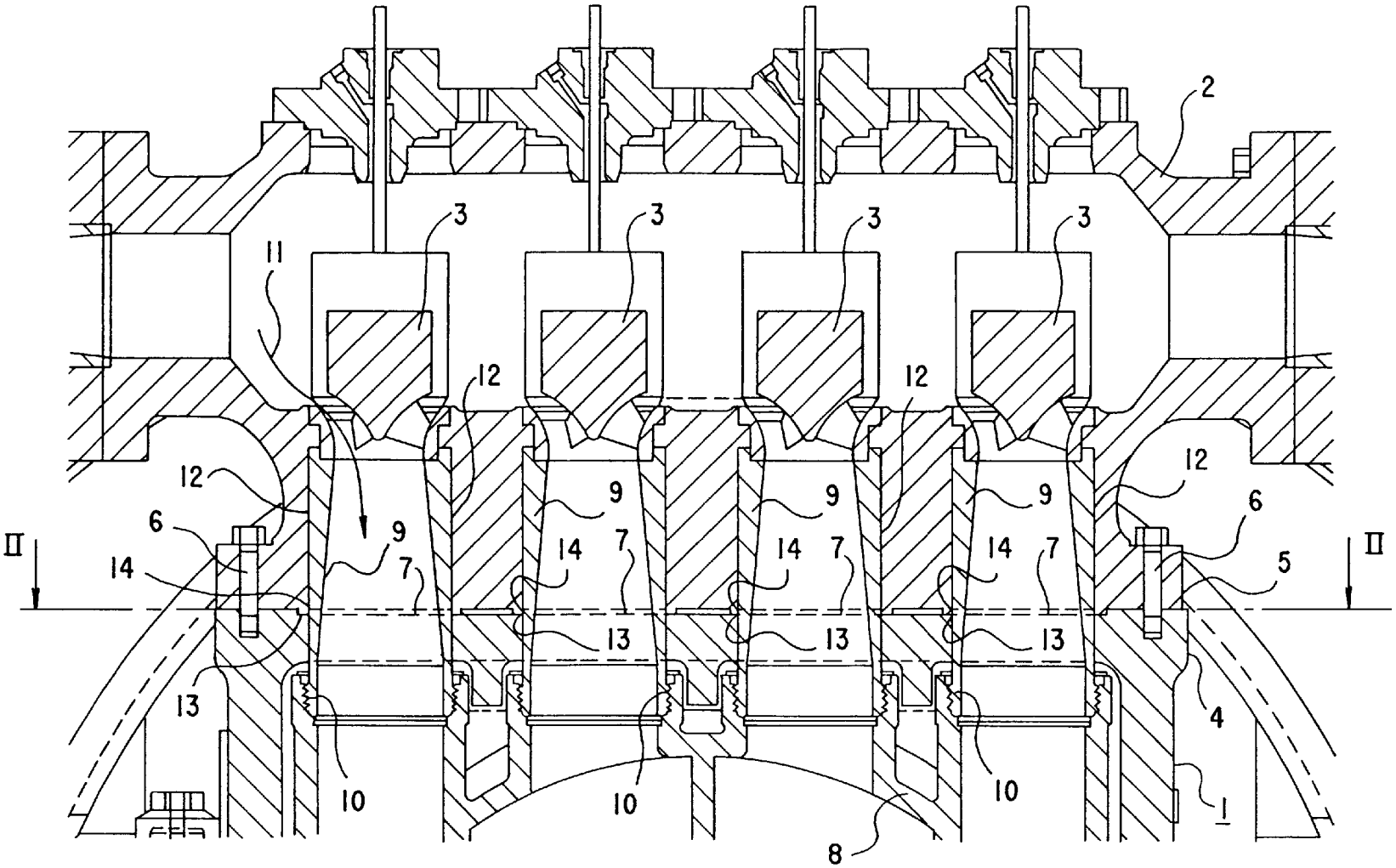
FIG. 1 is a diagrammatic, longitudinal sectional view through an admission section of a turbine casing having a flange-mounted control-valve casing according to the invention.

In all the figures of the drawing, sub-features and integral parts that correspond to one another bear the same reference symbol in each case. Referring now to the figures of the drawing in detail and first, particularly, to FIG. 1 thereof, there is shown a top region of an admission section 1 of a turbine casing of a steam turbine. On the admission section 1, a valve casing 2 having control valves 3 of which there are four in the exemplary embodiment, is mounted and is screwed to the admission section 1 via a flanged joint 4, 5. Provided for the screwed connection are a number of bolt-shaped screws 6, which are disposed in a distributed manner on a flange periphery in a region of a number of throughflow openings 7 corresponding to the number of control valves 3.

The screws 6 are in screw-thread engagement with the connecting flange 4 of the admission section 1.

The steam-side connection between each of the control valves 3 of the valve casing 2 and a nozzle casing 8, which is fastened in a thermally movable manner in an interior of the admission section 1, is effected in each case via a protective tube 9, which is fastened in the valve casing 2 and is configured as a diffuser. A steam-side seal between the protective tube 9 or each of the protective tubes 9 and the nozzle casing 8 is made by use of ring stacks 10, which are disposed in a thermally movable manner in the nozzle casing 8 and are configured like piston rings.

On the one hand, live steam having a high temperature flows in a direction of arrow 11 via the control valves 3 and through the throughflow openings 7 into the admission section 1. On the other hand, a high live-steam pressure, is kept away from the casing of the admission section 1 by the protective tubes 9. In the process, a chamber pressure which prevails in the interior of the admission section 1 of the turbine casing during operation of the steam turbine develops in an annular space 12, which is created between each of the protective tubes 9 and the casing walls of the valve casing 2 and the admission section 1.

A seal between the admission section 1 and the valve casing 2 is made by a surface pressure of two metallic sealing surfaces on one another, which face one another without additional sealing material in between. To this end, an encircling shoulder contour 13, in which a corresponding collar contour 14 of the valve casing 2 engages, is provided like a tongue-and-groove joint in a marginal region of each of the throughflow openings 7 of the admission section 1.

Figure 2:
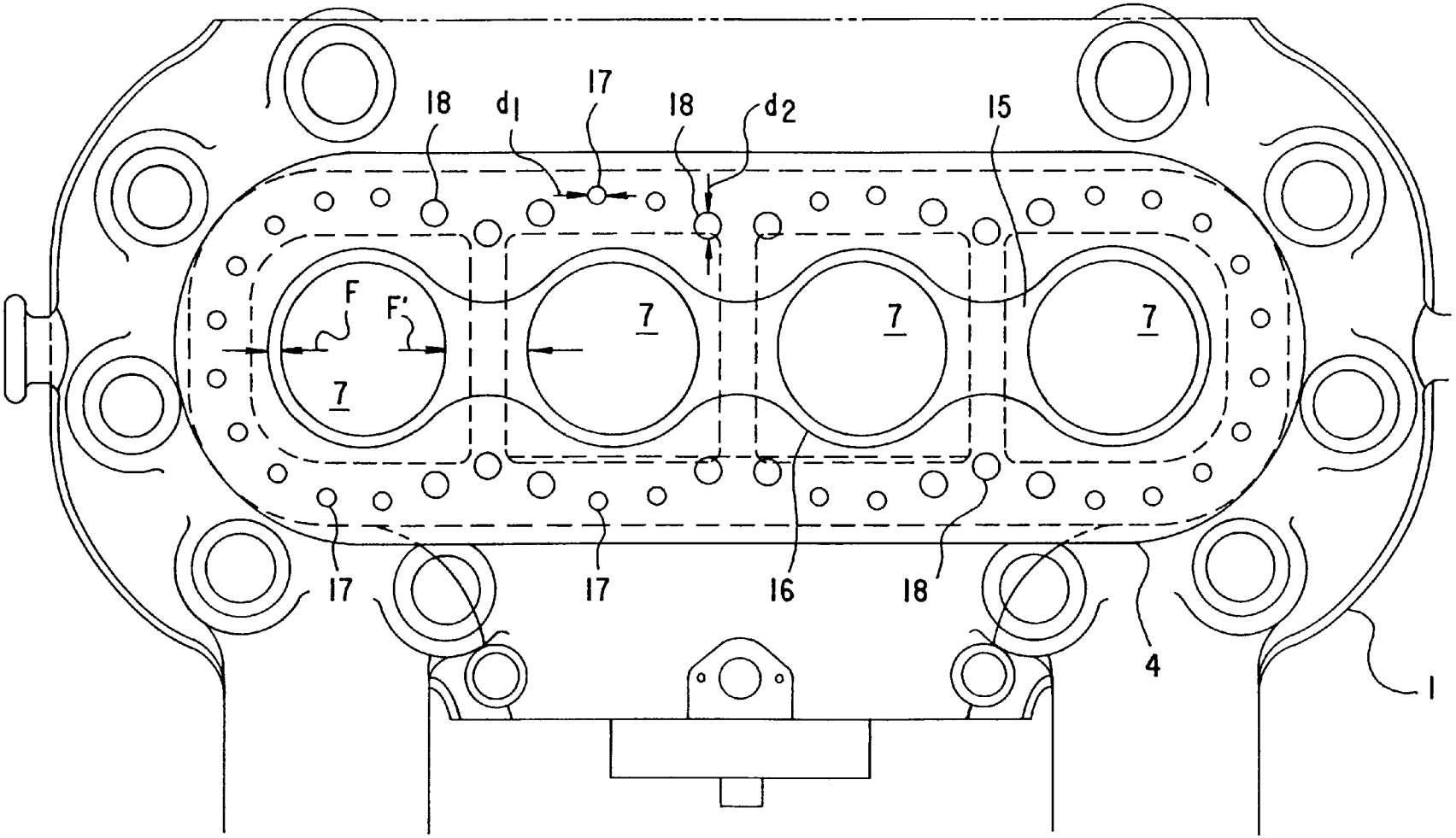
FIG. 2 is a cross-sectional view taken along the line II—II shown in FIG. 1 of a flanged joint having a sealing surface in a region of throughflow openings of an admission section.

FIG. 2 shows a sealing surface 15 of the connecting flange 4 of the admission section 1, which sealing surface 15 is created by the shoulder contour 13. An inner contour of the sealing surface 15 corresponds to the opening contour of the individual throughflow openings 7, which are circular in the exemplary embodiment, so that the latter are each completely enclosed by the sealing surface 15. In this case, a radial web width F of the sealing surface 15 at each of the throughflow openings 7 in outer regions of the latter is smaller than the radial web width F'/2 in a region between adjacent throughflow openings 7. Sealing surfaces of the collar contour 14 of the connecting flange 5 of the valve casing 2 are of circular shape, their web width being slightly smaller than the web width F of the sealing surface 15.

An outer contour 16 of the sealing surface 15 is expediently configured so as to be constricted in the region between the throughflow openings 7 and at the same time is adapted, to a very large extent, to the overall contour of the configuration of the throughflow openings 7. A configuration of screw holes 17, 18 for the location of the screw bolts 6 is also advantageously adapted to the outer contour 16. In this case, the screw holes 17, 18 are each disposed at an equal radial distance from a corresponding throughflow opening 7, so that each of the throughflow openings 7 is surrounded more or less completely by screw holes 17, 18. After a screwed connection has been made, it ensures an especially reliable seal for each individual throughflow opening 7 and thus for the entire flanged joint 4, 5.

To achieve an especially high surface pressure between the sealing surface 15 of the admission section 1 and the corresponding sealing surfaces of the valve casing 2, the crew holes 17 and 18 have different diameters $d_1$ and $d_2$ espectively. Accordingly, the respective screw bolts 6 are of different thickness (diameters). The screw holes 18 having a comparatively large diameter $d_2$ are expediently provided merely in the region between the throughflow openings 7 and thus in the constricted regions of the outer contour 16 of the sealing surface 15. In this case, three screw holes 18 of large diameter $d_2$, which face one another in each case, are disposed symmetrically, in each case on either side, in the two outer constricted regions. Whereas only two screw holes 18 of the same diameter $d_2$ which face one another in each case, are provided, in each case on either side, in the center constricted region of the outer contour 16 of the sealing surface 15.

We claim:

1. An admission section of a turbine casing of a steam turbine, the admission section comprising:

a flanged joint having at least two throughflow openings formed therein and being connectable to a further flanged joint of a valve housing for control valves, said flanged joint having a sealing surface with an outer contour completely enclosing each of said at least two throughflow openings, said flanged joint further having a configuration of screw holes formed therein for receiving screws and adapted to said outer contour of said sealing surface.

2. The admission section according to claim 1, wherein said sealing surface in regions between adjacent throughflow openings of said at least two throughflow openings has a constricted outer contour.

3. The admission section according to claim 1, wherein said configuration of screw holes has screw holes of at least two different diameters disposed along said sealing surface of each respective throughflow opening of said at least two throughflow openings.

4. The admission section according to claim 1, wherein the valve casing has a collar contour, and said flanged joint has a shoulder contour formed in a marginal region of each of said at least two throughflow openings for seating the collar contour of the valve casing.

5. A turbine casing of a steam turbine having an admission section, comprising:

a flanged joint having at least two throughflow openings formed therein and being connectable to a further flanged joint of a valve housing for control valves, said flanged joint having a sealing surface with an outer contour completely enclosing each of said at least two throughflow openings, said flanged joint further having a configuration of screw holes formed therein for receiving screws and adapted to said outer contour of said sealing surface.

6. A steam turbine having a turbine casing with an admission section, comprising:

a flanged joint having at least two throughflow openings formed therein and being connectable to a further flanged joint of a valve housing for control valves, said flanged joint having a sealing surface with an outer contour completely enclosing each of said at least two throughflow openings, said flanged joint further having a configuration of screw holes formed therein for receiving screws and said configuration of screw holes adapted to said outer contour of said sealing surface.

* * * * *